US012133581B2

(12) United States Patent
Peterson

(10) Patent No.: US 12,133,581 B2
(45) **Date of Patent: *Nov. 5, 2024**

(54) JEWELRY CLASP OPENING TOOL

(71) Applicant: Monica Peterson, Nampa, ID (US)

(72) Inventor: Monica Peterson, Nampa, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/349,521

(22) Filed: Jul. 10, 2023

(65) Prior Publication Data

US 2023/0346085 A1 Nov. 2, 2023

Related U.S. Application Data

(63) Continuation of application No. 17/564,541, filed on Dec. 29, 2021, now Pat. No. 11,737,526.

(60) Provisional application No. 63/146,160, filed on Feb. 5, 2021.

(51) Int. Cl.
*A44C 5/20* (2006.01)
*A44C 9/00* (2006.01)

(52) U.S. Cl.
CPC ..... *A44C 5/2033* (2013.01); *A44C 9/0046* (2013.01)

(58) Field of Classification Search
CPC ... A44C 5/2033; A44C 9/0046; A44C 5/2014; B25B 9/04; A47G 25/901; A47G 25/90
See application file for complete search history.

(56) References Cited

U.S. PATENT DOCUMENTS 5,709,327 A * 1/1998 LaMacchia ..... A44C 5/00 223/111
5,741,035 A * 4/1998 Glass ..... B25B 9/00 24/3.11
5,855,401 A * 1/1999 Papernik ..... A47G 25/901 24/40
5,934,526 A * 8/1999 Rosenbaum ..... A47G 25/901 223/111
6,032,996 A * 3/2000 Kogen ..... A47G 25/902 24/40
6,854,625 B2 * 2/2005 Tedeschi ..... A47G 25/901 223/111
7,284,684 B1 * 10/2007 Gharavi ..... A47G 25/901 223/111
7,712,643 B2 * 5/2010 Papernik ..... A47G 25/901 223/111
7,784,383 B2 * 8/2010 Salva ..... A47G 25/901 223/111
8,281,966 B2 * 10/2012 Rodgers ..... A47G 25/901 223/111
D708,090 S * 7/2014 Burns ..... D11/87

(Continued)

*Primary Examiner* — Robert Sandy
*Assistant Examiner* — Louis A Mercado
(74) *Attorney, Agent, or Firm* — Brennan, Manna & Diamond, LLC

(57) ABSTRACT

A small and handheld tool for opening small clasps and other closures. More specifically, the tool features an elongated handle, having a slider mechanism and a push button. The slider mechanism operates a slider or positioning arm and the spring-loaded push button operates a pair of clamps to hold the clasp in position. The slider arm and the pair of clamps extend from one end of the elongated handle. The pair of clamps secure the clasp between their rubber-tipped ends and the slider arm opens the clasp by moving a tab of the clasp radially along the surface of the clasp.

11 Claims, 5 Drawing Sheets

(56) References Cited

U.S. PATENT DOCUMENTS

| | | | | |
|---|---|---|---|---|
| 9,924,819 | B2 * | 3/2018 | Talberg | A47G 25/901 |
| 2006/0219741 | A1 * | 10/2006 | Clark | A47G 25/901<br>223/111 |

* cited by examiner

JEWELRY CLASP OPENING TOOL

CROSS-REFERENCE TO RELATED APPLICATION

The present application is a continuation of U.S. patent application Ser. No. 17/564,541, which was filed on Dec. 29, 2021, now U.S. Pat. No. 11,737,526, which was issued on Aug. 29, 2023 and claims priority from U.S. Provisional Application No. 63/146,160, which was filed on Feb. 5, 2021, both of which are incorporated herein by reference in their entirety.

FIELD OF THE INVENTION

The present invention relates generally to the field of accessories and tools for use with jewelry and other delicate items. More specifically, the present invention relates to a handheld jewelry clasp opening tool. The tool is designed for opening small jewelry clasps or other delicate items for easy application and placement on different areas of the body or a surface. More specifically, the tool features a slider mechanism to operate a slider arm and a spring-loaded push button to operate a pair of clamps to hold the workpiece. The pair of clamps secure the jewelry clasp between their rubber tipped appendages and the slider arm opens the clasp or clip by moving a tab or fastener of the clasp radially along the surface of the clasp or clip. The tool also includes an independent rubber-tipped clamp for holding a workpiece or jewelry item, such as an O-ring, for easily placing it within the opening of the clasp or clip. Accordingly, the present disclosure makes specific reference thereto. Nonetheless, it is to be appreciated that aspects of the present invention are also equally applicable to other like applications, devices and methods of manufacture.

BACKGROUND

By way of background, various ornaments, chains, keepsakes, crafts and jewelry such as necklaces, bracelets and the like are worn by people in day-to-day life. Generally, necklaces and bracelets are of chain style, usually formed by small metal rings, that use different closure mechanism for the item. For closure mechanisms, different kinds of clasps, clips, fasteners such as spring ring clasp, clip, lobster clasp and others are often used. The jewelry clasps, clips, fasteners and other closures are usually small in size in order to match the delicate nature and designs of the jewelry and other keepsakes and are one of the key components used while making an item such as jewelry. These clasps or clips are not only used for closing or opening the jewelry, but can also be used to adjust the size of the necklace, bracelet and other items as per the needs and requirements of the user.

Although the standard small-sized jewelry clasps are designed and used to suit the individual requirements and convenience, however, it can be incredibly difficult for people to open such small clasps or clips on jewelry and other items. People may have trouble grasping the small clasp or clip and then applying the jewelry or workpiece around the neck, around a wrist, or on another surface. Also, people with limited physical dexterity or eyesight problems may be unable to independently apply their favorite jewelry or item.

In such scenarios, people may need assistance from others in order to open or close the jewelry or other fashion accessory around the neck or wrist. People assisting others in wearing jewelry or other fashion pieces may face similar problems in grasping the clasps or clips with their hands and may fail in their ability to help others while applying jewelry, fashion items or other pieces or items.

Therefore, there exists a long felt need in the art for a device that helps people in easily wearing jewelry such as necklaces, bracelets and other fashion accessories, as well as to engage in crafting activities to decorate or accessorize various workpieces. There is also a long felt need in the art for a small clasp or clip opener device that eliminates the need to get assistance from other while wearing jewelry or fashion pieces around neck and wrist or doing craft or model work which requires significant dexterity and fine detail. Additionally, there is a long felt need in the art for a convenient to use clip or clasp opening device that enables the users to open and close the claps or clips on the items themselves, without any hassles or frustration. Moreover, there is a long felt need in the art for a device that allows the users to properly grasp the clasp or clip in order to open or close the clasp or clip to secure the jewelry or other workpiece. Further, there is a long felt need in the art for a delicate or small clasp or clip opening device that allows the people with eyesight problems to be able to easily open or close the jewelry or other workpiece without wasting a significant amount of effort and time. Furthermore, there is a long felt need in the art for a small or delicate clasp or clip opening device that allows the people with physical dexterity to readily and properly grasp the clasp and clip while easily opening or closing the clasp or clip lock. Finally, there is a long felt need in the art for a small clasp or clip opening device that allows individuals to independently wear jewelry, or fashion accessories around their neck or wrist with minimal effort as well as to work with delicate crafts, models and other intricate assemblies.

The subject matter disclosed and claimed herein, in one embodiment thereof, comprises a small handheld clip or clasp-opening tool. The clip or clasp-opening tool offers a way for a user to maintain independent application of their own jewelry, fashion accessory or other delicate item to customize their look and style without seeking help from anyone else. The tool features an elongated handle, a slider arm slidably extending from the elongated handle and having a slot to secure to a fastener of the clip or clasp. A pair of clamps extend from the handle and has rubber-tipped appendages. The rubber-tipped appendages are used for securing the jewelry and other fashion accessories clip or clasp between them. A slider mechanism slides the slider arm to slide the fastener of the clasp or clip radially along the surface of the clip or clasp to open the clasp or other closure. A push button operates the pair of clamps and is configured to move the rubber-tipped appendages away from each other to release the secured clasp or clip.

In this manner, the novel intricate clasp or clip opening tool of the present invention accomplishes all of the forgoing objectives and provides a relatively easy and convenient solution for people to wear jewelry and other fashion accessories as well as to work on delicate crafts and models. The clip or clasp opening tool of the present invention is also user-friendly, as it enables the users to wear the jewelry independently and eliminates the need to ask for assistance while applying jewelry or working with other items. Additionally, the clip or clasp opening tool helps the users to properly grasp the clasp, clip, fastener, or other closure without wasting significant effort and time of the user.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a handheld clip or clasp opening tool. The clip or clasp opening tool is designed for opening small clasps for easy application to different areas of the body or surfaces where the workpiece is located. The tool further includes an elongated handle having a top end and a bottom end, and a slider arm slidably extending from the top end and having a slot to secure to a fastener of the clasp clip or. A pair of clamps extend from the top end and have rubber-tipped appendages. The rubber-tipped appendages are used for securing the jewelry clasp between them. A slider mechanism is disposed in the elongated handle and is configured to slide the slider arm along a groove disposed near the top end in the handle. A push button is provided to operate the pair of clamps and configured to move the rubber-tipped appendages away from each other to release the secured clip or clasp. The slider arm slides the fastener radially along the surface of the clip, closure or clasp to open the clip, closure or clasp while the closure is securely held between the rubber-tipped appendages of the clamps.

In yet another embodiment of the present invention, the tool has an independent rubber-tipped clamp for securing another workpiece such as an O-ring for placing in the clasp or closure and a cover for securely storing the tool.

In yet another embodiment, the slot of the slider arm grasps the fastener or tab of the clasp or closure and moves the fastener along a groove disposed within the clasp, such that when the slider arm slides backwards from the top end of the elongated handle to create an opening.

In yet another embodiment of the present invention, a small handheld tool for opening a closure is disclosed. The tool includes an elongated handle having a spring-loaded push button and a sliding button. The spring-loaded push button is used for operating a pair of clamps for holding a closure, clip or clasp, and the sliding button operates a sliding arm capable of opening the closure or clasp. The sliding arm has a slot to secure a fastener of the workpiece clasp or closure.

In yet another embodiment of the present invention, the sliding arm includes a longitudinal portion and a hooked portion, with the hooked portion having the slot.

In yet another embodiment, the push button is positioned at one of the ends of the elongated handle and is coupled to the pair of clamps.

In yet another embodiment, the clamps can hold the clasp or closure having thickness in the range 1 mm-10 mm.

In yet another embodiment, the tool can be used for holding a lobster clasp, spring ring clasp, hook clasp and other intricate closures.

In yet another embodiment of the present invention, a method is presented for opening a closure, clip or clasp such as a lobster clasp, spring ring clasp or more, using a small clasp-opening tool. The method includes the steps of providing the closure or clasp opening tool, with the tool having a slider arm, a pair of clamps, a push button and a slider button. The method further includes pushing the spring-loaded push button to open the pair of clamps such that the rubber-tipped appendages of the clamps, closures or clips are spaced apart from each other to secure a closure, clip, clasp and fastener or tab of the closure is secured in the slot of the sliding arm, then pushing the slider button to slide the slider arm to open the clasp by radially moving the fastener along the surface of the clasp. Then placing another workpiece in the open holder and finally sliding the slider button to slide the slider arm in opposite direction to close the clasp or closure.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
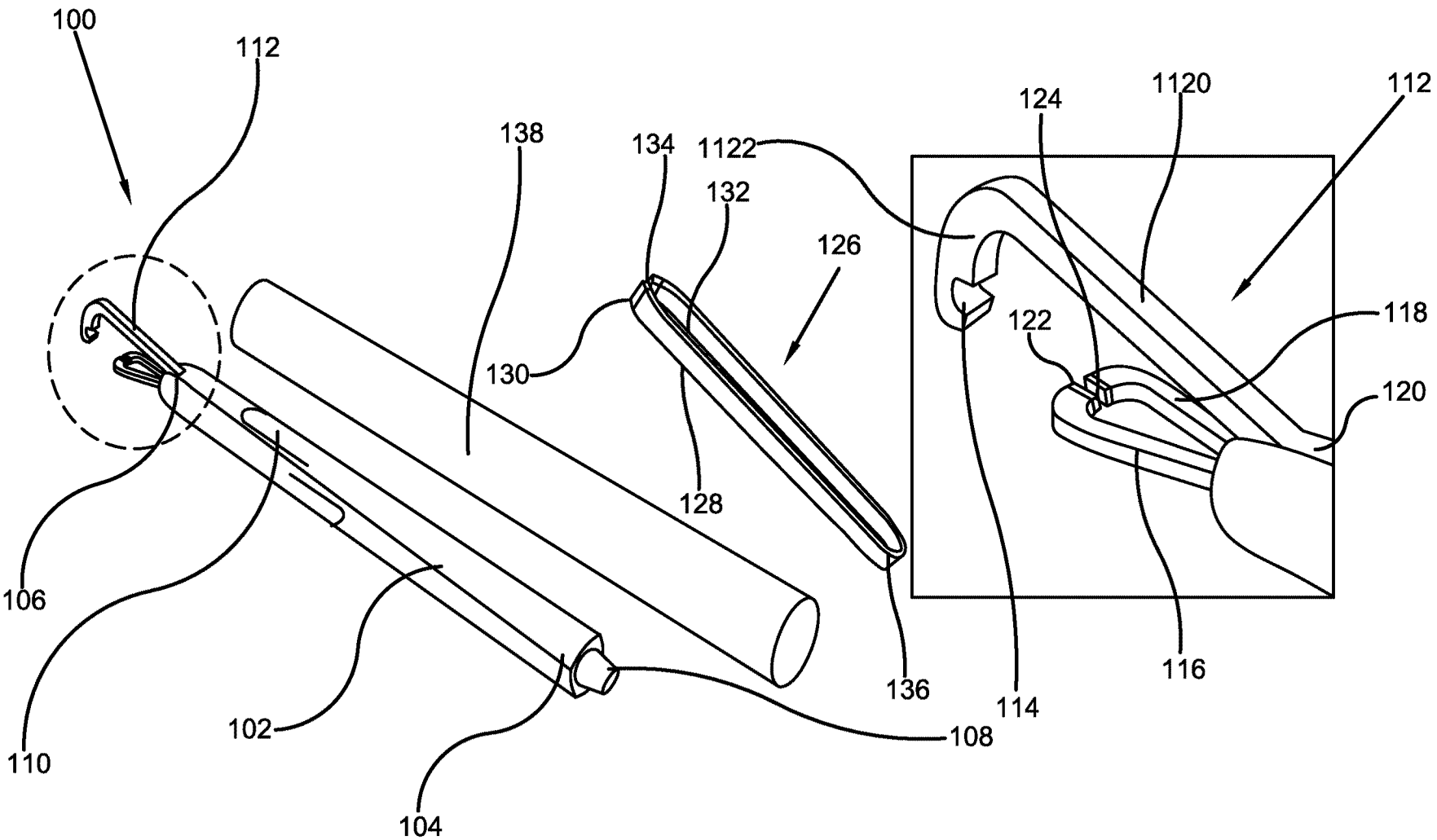
FIG. 1 illustrates a perspective view of one potential embodiment of the jewelry clasp opening tool of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long felt need in the art for a device that helps people to easily wear jewelry such as necklaces, bracelets and other fashion accessories, as well as to work on intricate workpieces found in crafts and model work. There is also a long felt need in the art for a closure, clip or clasp opening device that eliminates the need to seek assistance from others while wearing jewelry around the neck and wrist or ears, or other fashion accessories. Additionally, there is a long felt need in the art for a closure, clip or clasp opening device that enables the users to open and close the jewelry and other workpieces themselves, without any inconvenience. Moreover, there is a long felt need in the art for a device that allows the users to properly grasp the closure, clip or clasp in order to open or close the workpiece. Further, there is a long felt need in the art for a closure, clip or clasp opening device that allows the people with eyesight problems to easily open and close the jewelry or workpiece, without wasting significant effort and time. Furthermore, there is a long felt need in the art for a closure, clip, fastener or clasp opening device that allows people with physical dexterity to be able to properly grasp the clasp or closure, and easily open or close the clasp lock or fastener to secure the piece in position. Finally, there is a long felt need in the art for a clip, closure, fastener or clasp opening device that allows the users to independently wear jewelry around their neck or wrist or to wear other fashion accessory or to engage in completely other workpieces with minimal effort.

The present invention, in one exemplary embodiment, is a novel method for opening a clip, clasp, closure or fastener. The method includes the steps of providing a clasp, clip, fastener or closure opening tool. The tool includes a slider arm, a pair of clamps, a push button and a slider button. The method further includes pushing the spring-loaded push button to open the pair of clamps, such that the rubber-tipped appendages of the clamps are spaced-apart from each other to secure a workpiece clasp, closure and fastener or tab of the clasp is secured in the slot of the sliding arm. Then, pushing the slider button to slide the slider arm to open the clasp, clip, fastener or closure by radially moving the fastener along the surface of the clasp, thereafter placing another workpiece in the open clasp, and finally sliding slider button to slide the slider arm in the opposite direction to close the clasp.

Referring initially to the drawings, FIG. 1 illustrates a perspective view showing closure, clasp, fastener or clip-opening tool of the present invention in accordance with the disclosed specification. The fastener, clip or clasp opening tool 100 of the present invention is a unique and novel handheld tool designed for opening intricate or delicate clasps or closures. The handheld tool 100 can be used for opening the clasps, closures, clips or other fasteners, such as a lobster claw, spring ring and many more, without damaging the workpiece. The tool 100 allows users to keep the workpiece clasp open with minimal effort and physical dexterity required. More specifically, the tool 100 includes an elongated handle 102 that has a first end 104 and a second end 106. At the first end 104, a spring-loaded push button 108 is disposed that is used for controlling the movement of the clamps 116, 118. The spring-loaded push button 108 is connected internally to the clamps 116, 118 and the clamps 116, 118 are used for securing a jewelry clasp between them. The tool 100 has a slider 110 positioned on the elongated handle 102 and the slider 110 is used for controlling the sliding movement of a slider arm 112. The slider arm 112 and the clamps 116, 118 extend from the second end 106 of the elongated handle 102.

Figure 2:
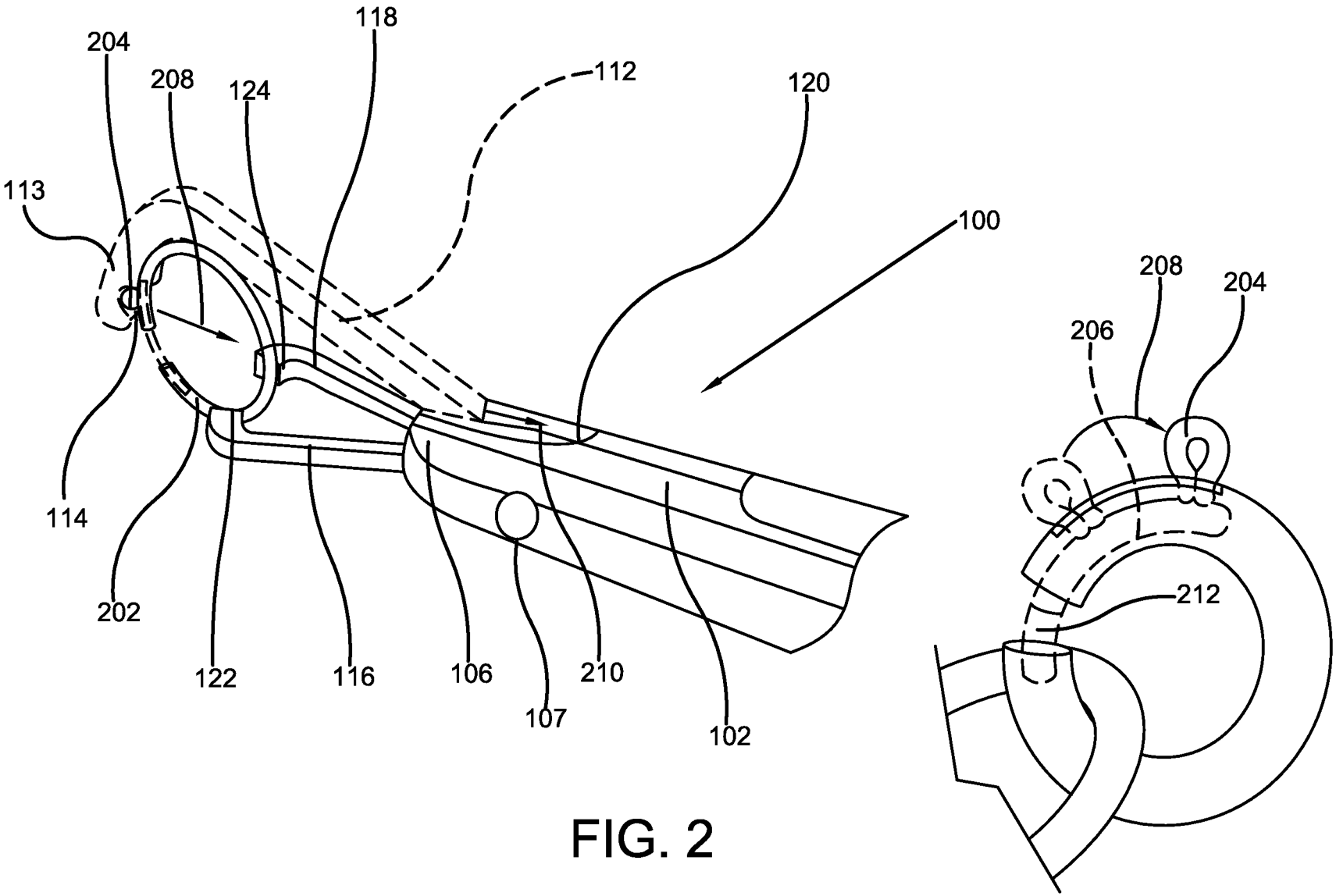
FIG. 2 illustrates a perspective view of one potential embodiment of the jewelry clasp opening tool of the present invention being used to open a jewelry spring ring clasp in accordance with the disclosed architecture.

The slider arm 112 together with the clamps 116, 118 is used for opening clasps, clips, closures or fasteners, while the clamps 116, 118 hold the workpiece clasp. The slider arm 112 is configured to slide along a groove 120, formed in the elongated handle 102. The slider arm 112 has a curved end 113 and the slider arm is disposed inwardly from the end of the handle 102. The slider arm 112 has a longitudinal length 1120 and a hooked length 1122, substantially perpendicular to the longitudinal length 1120. The hooked length 1122 has a slot 114 to hold a fastener of a jewelry clasp as best shown in FIG. 2. While the slider arm 112 slides in the groove 120, the jewelry clasp is held securely between the first rubber-tipped appendage 122 of the first clamp 116 and the second rubber-tipped appendage 124 of the second clamp 118.

For sliding the slider arm 112, a user slides the slider 110 along the elongated handle 102 and the slider arm 112 slides in a backward or forward direction along the groove 120. When the spring-loaded push button 108 is pushed by a user, the rubber-tipped appendages 122, 124 of the clamps 116, 118 move away from each other to create an opening for a workpiece clasp and when the spring-loaded push button 108 is released, the rubber-tipped appendages 122, 124 secure the jewelry clasp between them. The clamps 116 and 118 may have a locking button 107 which will hold the clamps in position until released (as seen in FIG. 2).

Figure 3:
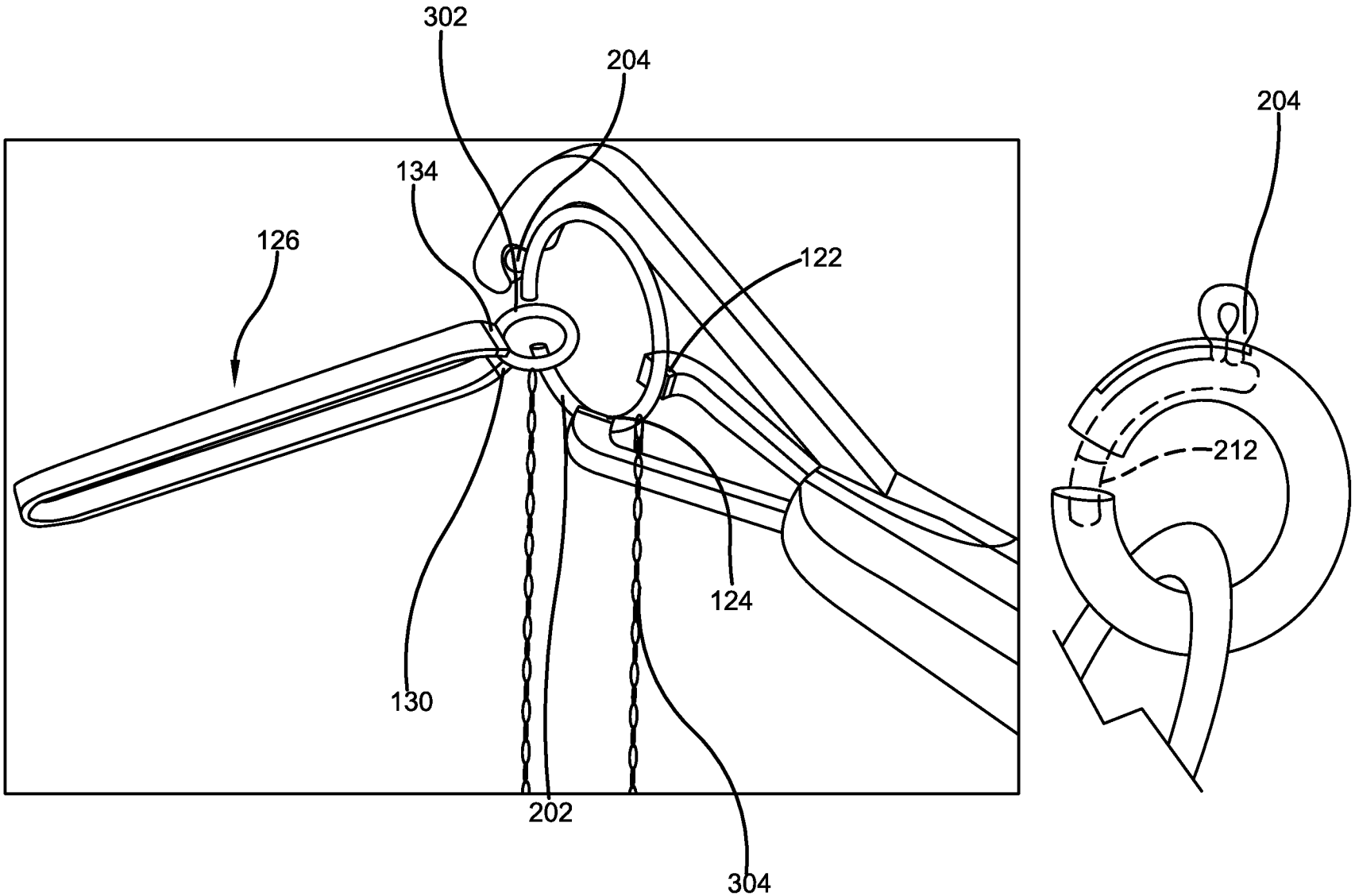
FIG. 3 illustrates a perspective view of the jewelry spring ring clasp in an open position and one potential embodiment of the independent rubber-tipped clamp of the present invention being used to place the O-ring in the closure or clasp in accordance with the disclosed architecture.

The tool 100 also includes an independent rubber tipped clamp 126 along with the elongated handle 102. The independent rubber tipped clamp 126 has two clamp arms 128, 132 having a common joint 136, and has rubber tips at their open ends. The first independent clamp arm 128 has the rubber tip 130 and the second independent arm 132 has the rubber tip 134. The rubber tips 130, 134 can be used for holding another workpiece, such as an O-ring, for easily placing it in the clasp as best shown in FIG. 3.

A cover 138 can be used for securely storing the elongated handle 102 and the independent rubber-tipped clamp 126. The cover 138 can be commercially available as a part of the tool 100. The cover 138 can be made from plastic, metal or any other similar hard and durable material.

FIG. 2 illustrates a perspective view showing a workpiece spring ring clasp 202 being positioned between the clamps 116, 118, and the fastener 204 being secured to the slot 114 for opening the clasp 202 easily by the clasp or closure opening tool 100 of the present invention in accordance with the disclosed structure. As shown, the exemplary spring ring clasp 202 is placed between the rubber tip 122 of the first clamp 116 and the rubber tip 124 of the second clamp 118. The clamps 116, 118 are configured such that the rubber tips 122, 124 move away from each other and the clamps 116, 118 remain connected at the second end 106 of the elongated handle 102 on pushing the spring-loaded push button positioned at the first end of the elongated handle 102. An advantage of the rubber tips 122, 124 is that they do not damage the jewelry clasp 202 when the clasp 202 is held between them. The tips can be made from a neoprene rubber and the clamps can apply a pressure ranging between 50 psi and 200 psi, so as to not to damage the workpiece.

The fastener 204 of the clasp 202 is positioned in the slot 114 that enables the slider arm 112 to radially slide back the fastener 204 along the bore 206 in the direction 208 when the slider arm 112 moves along the groove 120 in the rear direction 210. The sliding mechanism allows a user to create an opening 212 in the clasp 202 with minimal effort. When the slider button disposed on the handle 102 is released, the slider arm 112 slides in a forward direction along the groove 120, and can be used to close the closure or clasp 202 allowing the fastener 204 to reach the initial position.

FIG. 3 illustrates a perspective view showing the closure or clasp 202 in an open position, and the independent rubber-tipped clamp used for placing the O-ring 302 in the closure or clasp in accordance with the disclosed specification. As shown, the closure or clasp 202 is in an open position with the opening 212 is used for inserting an O-ring 302. Any type of O-ring used for holding a workpiece, such as a chain 304, can be used. For holding and placing the O-ring 302, the independent rubber tipped clamp 126 is used and the O-ring 302 is held between the rubber tips 130, 134 of the clamp 126.

In use, the O-ring 302 is inserted into the clasp 202 through the opening 212 while the slider arm 122 slides back the fastener 204 for creating the opening 212. A user independently can hold the O-ring 302 in the independent rubber-tipped clamp 126 using one hand, while holding the clasp 202 in an open position using the other hand. This allows users to maintain independent application of a workpiece to customize their look and style or to complete the work.

Figure 4:
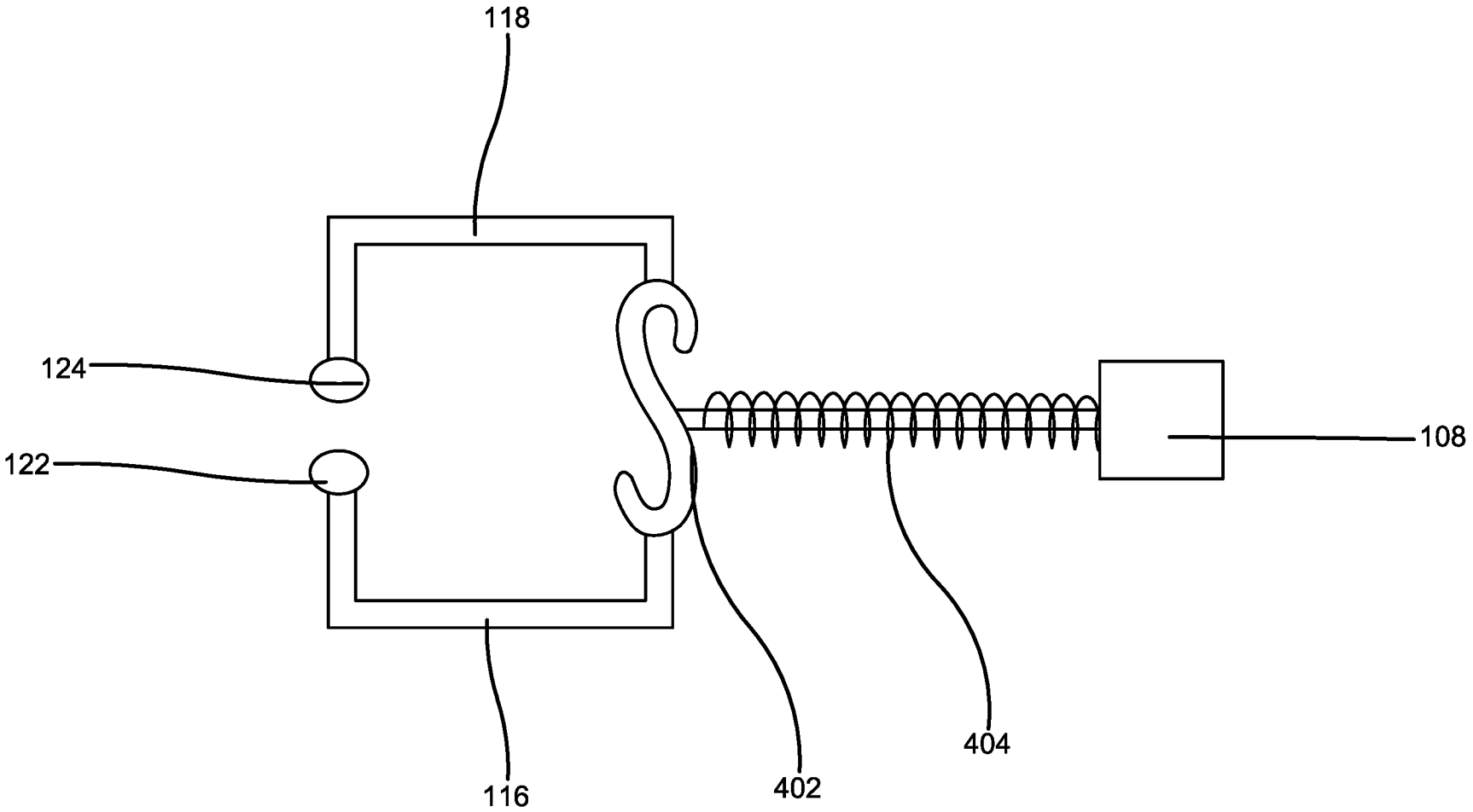
FIG. 4 illustrates an internal view of the coupling of the spring-loaded push button and the clamps for controlling movement of the clamps in accordance with the disclosed architecture.

FIG. 4 illustrates an internal view showing the coupling of the spring-loaded push button 108 and the clamps 116, 118 for controlling the movement of the clamps 116, 118 in accordance with the disclosed specification. As stated earlier, the pair of clamps 116, 118 are operated via the spring-loaded push button 108. The spring-loaded push button 108 is pushed by a user. The spring 404 connects the push button 108 to a hook 402, which pulls the connected stainless-steel hook 402 such that the stainless-steel hook 402 is coupled to the first clamp 116 and second clamp 118. When the stainless-steel hook 402 is pulled, the rubber tip appendages 122, 124 of the clamps 116, 118 are pulled away from each other, thereby allowing a clasp to be placed between the rubber tip appendages 122, 124. When the push button 108 is released, the stainless-steel hook 402 is pushed that enables the rubber tip appendages 122, 124 to push towards each other to secure the clasp between the appendages 122, 124.

Figure 5:
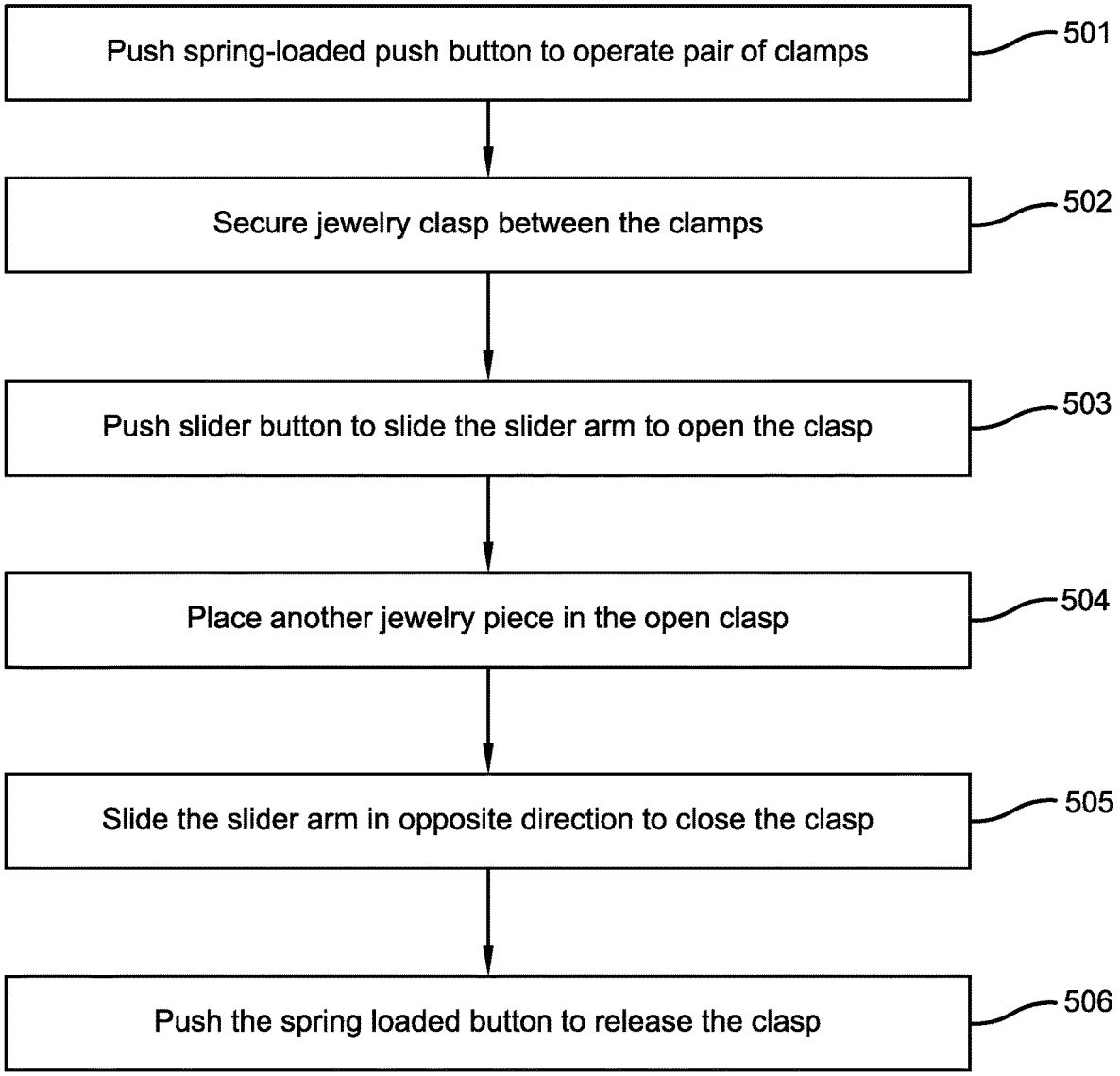
FIG. 5 illustrates a flow diagram of the exemplary steps performed in using the jewelry clasp opening tool of the present invention for easily opening a jewelry clasp or other closure in accordance with the disclosed architecture.

FIG. 5 illustrates a flow diagram showing exemplary steps performed in using the closure, clip, fastener or clasp-opening tool of the present invention for opening a clasp easily in accordance with the disclosed specification. Initially, the spring-loaded push button is depressed by a user that operates the pair of clamps (Block 501). The rubber-tipped appendages of the clamps are pulled away from each other and used for securing the closure or clasp between the appendages (Block 502). To secure the fastener or clasp, the push button is released, which enables the appendages to secure the clasp or closure without damaging or de-shaping the clasp, closure or clip. Thereafter, the slider arm is slid back along the surface of the handle of the tool to push the fastener of the clasp radially backwards to open the clasp and create an opening (Block 503). The clasp is opened in a conventional manner, with the fastener moving in a groove to create the opening. Then, another piece of jewelry such as an O-ring is put into the clasp (Block 504). Then, to close the clasp, the slider arm is pushed in a forward direction along the elongated handle to close the opening (Block 505). Finally, to release the clasp from the tool, the spring-loaded push button is again pushed to operate the clamps and release the clasp from the clamps (Block 506).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "jewelry clasp opening tool", "clasp opening tool", "handheld tool", and "tool" are interchangeable and refer to the jewelry clasp opening tool 100 of the present invention.

Notwithstanding the forgoing, the jewelry clasp opening tool 100 of the present invention can be of any suitable size and configuration as is known in the art without affecting the overall concept of the invention, provided that it accomplishes the above-stated objectives. One of ordinary skill in the art will appreciate that the size, configuration and material of the jewelry clasp opening tool 100 as shown in the FIGS. are for illustrative purposes only, and that many other sizes and shapes of the jewelry clasp opening tool 100 are well within the scope of the present disclosure. Although the dimensions of the jewelry clasp opening tool 100 are important design parameters for user convenience, the jewelry clasp opening tool 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A clasp opening tool for use with an intricate workpiece, the clasp opening tool comprising:

a handle having a first end and a second end;

a pair of clamping arms extending out of the first end, each of the clamping arm comprising a rubber tipped appendage; and a positioning arm extending out of the first end above the pair of clamping arms, wherein the pair of clamping arms configured to clamp onto an intricate workpiece; and wherein the positioning arm is operable via a slider movable within a groove in the handle.

2. The clasp opening tool as recited in claim 1, wherein the positioning arm comprises a curved end.

3. The clasp opening tool as recited in claim 1, wherein the intricate workpiece is selected from a group consisting of an article of jewelry, a model, a craft and a fashion accessory.

4. The clasp opening tool as recited in claim 1, wherein the pair of clamping arms share a common joint.

5. A jewelry clasp opening tool comprising:

a handle having a first end and a second end;

a pair of clamping arms extending out of the first end, each of the clamping arm comprising a rubber tipped appendage;

a positioning arm extending out of the first end above the pair of clamping arms; and a clasp having a closure, wherein the clasp is held between the pair of clamping arms and the positioning arm has a curved end, and further wherein the positioning arm is repositionable along the handle to open the closure of the clasp when the clasp is held by the pair of clamping arms; and wherein the positioning arm is operable via a slider movable within a groove in the handle.

6. The jewelry clasp opening tool recited in claim 5, wherein the clasp is connected to one of an article of jewelry, a model, a craft or a fashion accessory.

7. The jewelry clasp opening tool recited in claim 5, wherein the handle further comprises a locking button to hold the pair of clamping arms in a desired position.

8. The jewelry clasp opening tool recited in claim 5, wherein the closure is a spring loaded closure and the positioning arm moves the spring loaded closure between an open position and a closed position.

9. The jewelry clasp opening tool as recited in claim 5, wherein the positioning arm works in association with the pair of clamping arms.

10. A combination clasp opening tool and jewelry, the combination comprising:

an article of jewelry having a clasp; and a clasp opening tool for opening the clasp, wherein the clasp opening tool comprises a handle, a pair of clamping arms extending out of the handle and a positioning arm extending out of the handle above the pair of clamping arms, and further wherein the positioning arm is repositionable along the handle via a slider movable within a groove in the handle and engages the clasp.

11. The combination as recited in claim 10, wherein each of the pair of clamping arms have tips covered with a rubber material.

* * * * *